US009331409B2

(12) United States Patent
Naganuma et al.

(10) Patent No.: US 9,331,409 B2
(45) Date of Patent: May 3, 2016

(54) ELECTRICAL CONNECTION DEVICE

(71) Applicant: Hirose Electric Co., Ltd., Tokyo (JP)

(72) Inventors: Kenichi Naganuma, Tokyo (JP); Masao Shimoyama, Tokyo (JP); Taro Taniguchi, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/707,057

(22) Filed: May 8, 2015

(65) Prior Publication Data

US 2015/0333442 A1 Nov. 19, 2015

(30) Foreign Application Priority Data

May 16, 2014 (JP) ..... 2014-102533

(51) Int. Cl.

| | |
|---|---|
| ***H01R 12/91*** | (2011.01) |
| ***H01R 13/629*** | (2006.01) |
| ***H01R 12/71*** | (2011.01) |
| ***H01R 13/631*** | (2006.01) |
| ***H01R 12/70*** | (2011.01) |
| ***H01R 13/11*** | (2006.01) |

(52) U.S. Cl.

CPC ..... *H01R 12/91* (2013.01); *H01R 12/7047* (2013.01); *H01R 12/7088* (2013.01); *H01R 12/712* (2013.01); *H01R 12/716* (2013.01); *H01R 13/113* (2013.01); *H01R 13/62933* (2013.01); *H01R 13/6315* (2013.01)

(58) Field of Classification Search

CPC ..... H01R 12/91; H01R 13/6315

See application file for complete search history.

(56) References Cited

U.S. PATENT DOCUMENTS

| | | | | |
|---|---|---|---|---|
| 5,431,576 | A | 7/1995 | Mattews | |
| 7,014,516 | B2 * | 3/2006 | Yang | H01R 13/187 439/170 |
| 7,581,972 | B2 * | 9/2009 | Daamen | H01R 13/6315 439/249 |
| 8,376,766 | B1 * | 2/2013 | Huettner | H01R 12/91 439/248 |
| 2006/0003616 | A1 * | 1/2006 | Narui | H01R 23/68 439/157 |
| 2013/0017729 | A1 * | 1/2013 | Kimura | H01R 13/6315 439/626 |
| 2014/0080339 | A1 * | 3/2014 | Ebisawa | H01R 13/6315 439/212 |
| 2015/0333442 | A1 * | 11/2015 | Naganuma | H01R 12/7047 439/121 |

* cited by examiner

*Primary Examiner* — James Harvey

(74) *Attorney, Agent, or Firm* — Kubotera & Associates, LLC

(57) ABSTRACT

An electrical connection device is to be attached to a wiring board for holding a plate conductive member so that the wiring board is electrically connected to the plate conductive member. The electrical connection device includes a contact piece including an arm portion, a leg portion, and a base portion disposed between the arm portion and the leg portion; and a base member to be attached to the wiring board for supporting the contact piece at the base portion thereof. The base member is to be attached to the wiring board so that the base member is movable in parallel to the wiring board. The contact piece is arranged so that the plate conductive member pushes the arm portion to urge the leg portion against the wiring board with the base portion as a pivot when the plate conductive member contacts with the arm portion.

8 Claims, 7 Drawing Sheets

ELECTRICAL CONNECTION DEVICE

BACKGROUND OF THE INVENTION AND RELATED ART STATEMENT

The present invention relates to an electrical connection device for connecting a busbar so that a large electrical current flows. More particularly, the invention relates to an electrical connection device for electrically connecting a wiring board with a plate conductive member.

Patent Reference has disclosed a conventional electrical connection device. FIG. 7 shows an example of a conventional electrical connection device 130 disclosed in Patent Reference.

Patent Reference: U.S. Pat. No. 5,431,576

According to Patent Reference, the conventional electrical connection device 130 includes contact sides 152 and 154 that have the same shape and are disposed to face each other. An opening 134 is formed between the contact sides 152 and 154, so that a plate connector (conductive member) 128 is inserted through the opening 134 to be secured on a substrate 109.

The conventional electrical connection device 130 is to be mounted on a back plate 112 with common fixing screws. With the fixing screws 162, the conventional electrical connection device 130 is completely fixed on the back plate 112.

According to the conventional electrical connection device 130, when the plate conductive member (connector) 128 is inserted in the conventional electrical connection device 130 through the opening 134 formed between the contact side 152 and the contact side 154, misalignment may occur between the plate conductive member 128 and the opening 134 of the electrical connection device 130 depending on an entering direction and/or position of the plate conductive member 128 relative to the opening 134. When the plate conductive member 128 is misaligned relative to the opening 134 of the electrical connection device 130, for example, undesired force may be generated near the fixing portion between the conventional electrical connection device 130 and the back plate 112, thereby making the large-current connection of the contact sides 152 and 154 with the back plate 112 and the plate conductive member unstable.

According to the conventional electrical connection device 130 disclosed in Patent reference, the misalignment between the plate conductive member 128 and the opening 134 of the electrical connection device 130 is accommodated by resilience of the contact bands 180, or by providing a clamping body 160 having a fold 174 inside the opening 134 of the electrical contacting device 130 so as to securely contact with the plate conductive member 128 from any directions.

However, when the misalignment is significant, or when high contact precision is required between the plate conductive member 128 and the clamping body 160, such accommodating means is not enough to accommodate the misalignment.

In view of the problems described above, an object of the present invention is to provide an electrical connection device that can securely electrically connect contact sides with a back plate and a plate conductive member, while accommodating misalignment between the plate conductive member and an opening of the electrical connection device.

Further objects and advantages of the present invention will be apparent from the following description of the present invention.

SUMMARY OF THE PRESENT INVENTION

In order to attain the objects described above, according to a first aspect of the present invention, an electrical connection device is for holding a plate conductive member upright on a planar surface of a wiring board and electrically connecting the plate conductive member with the wiring board. The electrical connection device includes a contact piece, and a base member for supporting the contact piece at a base portion provided between an arm portion and a leg portion of the contact piece. The electrical connection device is provided so as to be able to float on the planar surface of the wiring board. When the arm portion of the contact piece contacts with one planar surface of the plate conductive member, the arm portion is urged toward a side of the planar surface of the wiring board through the contact, and in response to this, the leg portion is urged to the side of the wiring board having the base portion as a fulcrum.

According to the first aspect of the invention, when the plate conductive member is held with the electrical connection device, the leg portion of the contact piece is urged to a side of the wiring board. Therefore, it is possible to push the leg portion of the contact piece toward the wiring board and thereby to enhance the contact between the leg portion and the wiring board. As a result, it is achievable to obtain secure electrical connection of the contact piece with the wiring board and the plate conductive member. In addition, when the plate conductive member is held with the electrical connection device, the leg portion of the contact piece also contacts with the wiring board with certain force. Therefore, it is achievable to stably hold the plate conductive member with the electrical connection device.

On the other hand, in a state before the plate conductive member is held with the electrical conductive member, the contact piece is attached to the base member with some space around the base portion. As a result, it is possible to have a certain play and to accommodate misalignment of the plate conductive member relative to the electrical connection device upon receiving the plate conductive member to the electrical connection device. Furthermore, when a floating movement is possible between the electrical connection device and the wiring board, it is also possible to easily accommodate misalignment of the plate conductive member relative to the electrical connection device upon receiving the plate conductive member to the electrical connection device.

According to a second aspect of the invention, in the electrical connection device, the arm portion of the contact piece extends along one planar surface of the plate conductive member, and the leg portion of the contact piece extends along the planar surface of the wiring board. The arm portion of the contact piece has a contact point so as to protrude toward the plate conductive member when the plate conductive member is held with the electrical connection device. With the contact point, an insertion opening is formed for inserting the plate conductive member therein. The insertion hole has preferably a size smaller than a thickness of the plate conductive member.

According the second aspect of the invention, when the insertion opening has the size smaller than the thickness of the plate conductive member, the arm portion of the contact piece certainly contacts with the one planar surface of the plate conductive member upon inserting the plate conductive member in the insertion opening. Therefore, with the leverage principle, the contact force occurred between the plate conductive member and the contact piece is to be certainly transmitted to the contact point of the leg portion.

According to a third aspect of the invention, in the electrical connection device, the contact piece is composed of a set of a first contact piece and a second contact piece. The first contact piece has a first arm portion having a first contact point and the second contact piece has a second arm portion having a second contact point. Between the first contact point and the second contact point, an insertion opening is formed for inserting the plate conductive member therein. When the first arm portion of the first contact piece contacts with the one planar surface of the plate conductive member, the first contact piece is urged to a side of the planar surface of the wiring board through the contact. In response, the first leg portion of the first contact piece is urged to a side of a planar surface of the wiring board, with the base portion serves as a fulcrum. When the second arm portion of the second contact piece contacts with the other planar surface of the plate conductive member, the second contact piece is urged to a side of the planar surface of the wiring board through the contact. In response, the second leg portion of the second contact piece is urged to a side of the wiring board, with the second base portion serves as a fulcrum.

According to the third aspect of the present invention, the plate conductive member is inserted in the electrical connection device through the insertion opening formed between the arm portion of the first contact piece and the arm portion of the second contact piece. When the plate conductive member is inserted in the electrical connection device, both the first contact piece and the second contact piece can contact with the both planar surfaces of the plate conductive member at the same time, thereby making it possible to evenly apply a force to the plate conductive member.

According to a fourth aspect of the invention, in the electrical connection device, preferably, there is provided a pressing member between the first base portion of the first contact piece and the second base portion of the second contact piece. With the pressing member, it is achievable to prevent the first contact piece and the second contact piece from coming off from a support member.

According to a fifth aspect of the invention, in the electrical connection device, the base member has an engaging protrusion or an engaging recess, and the pressing member has an engaging recess or an engaging protrusion at an opposing position to that of the engaging protrusion or the engaging recess of the base member. With the configuration, when the engaging protrusion of the base member or the engaging protrusion of the pressing member respectively penetrates through the first engaging hole of the first contact piece and the second engaging hole of the second contact piece, it is possible to place the engaging protrusion of the base member or the engaging protrusion of the pressing member in the engaging recess of the base member or the engaging recess of the pressing member.

According to the fifth aspect of the present invention, with a simple configuration, it is possible to rotatably support the first contact piece and the second contact piece between the one planar surface or the other planar surface of the plate conductive member and the wiring board.

According to a sixth aspect of the invention, the first contact piece and the second contact piece respectively may have certain widths. In addition, the first engaging hole of the first contact piece and the second engaging hole of the second contact piece may be enlarged in a width direction thereof.

When the engaging holes have the certain width, the support member can more stably support the first contact piece and the second contact piece.

According to a seventh aspect of the invention, the electrical connection device preferably includes a resin cover, which covers at least a part of outsides of the first contact piece and the second contact piece. With the resin cover, it is achievable to prevent the contact pieces from breaking, and protect a user thereof from electrical shock.

According to an eighth aspect of the invention, in the electrical connection device, the support member is preferably made of a metal material. When the support member is formed of the metal material, it is achievable to increase durability of the support member against the contact piece, and electrically connect the contact piece with the wiring board through the support member. In addition, it is also achievable to further reinforce the contact between the contact piece and the wiring board.

According to the invention, it is possible to provide the electrical connection device that stabilizes contact of the contact piece of the electrical connection device with the back plate and the plate conductive member, while accommodating misalignment upon receiving the plate conductive member in the electrical connection device on the back plate.

DETAILED DESCRIPTION OF THE PREFERRED EMBODIMENTS

Hereunder, embodiments of the present invention will be described with reference to the accompanying drawings.

Figure 1:
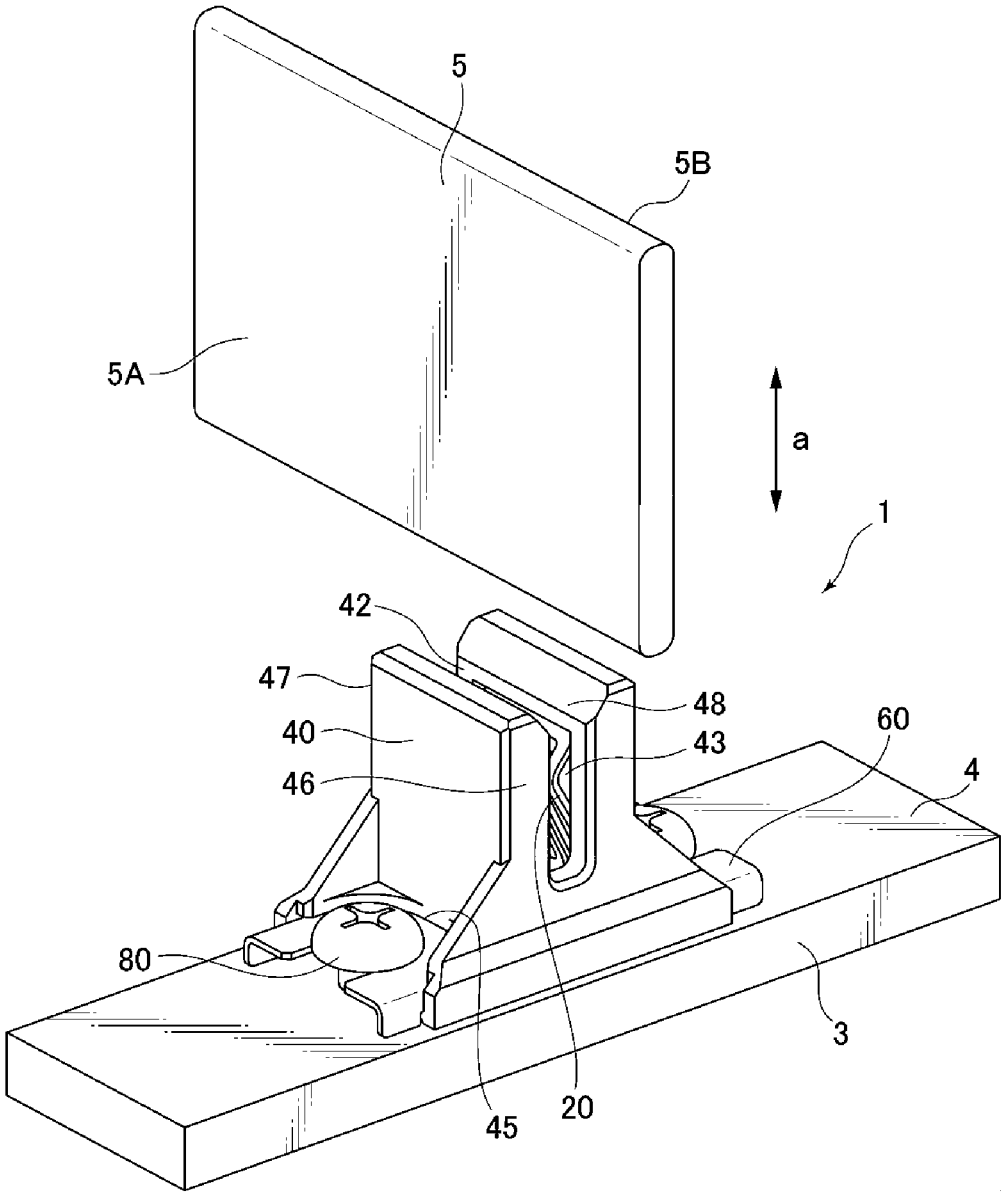
FIG. 1 is a perspective view showing an electrical connection device in use according to an embodiment of the present invention.
Figure 2:
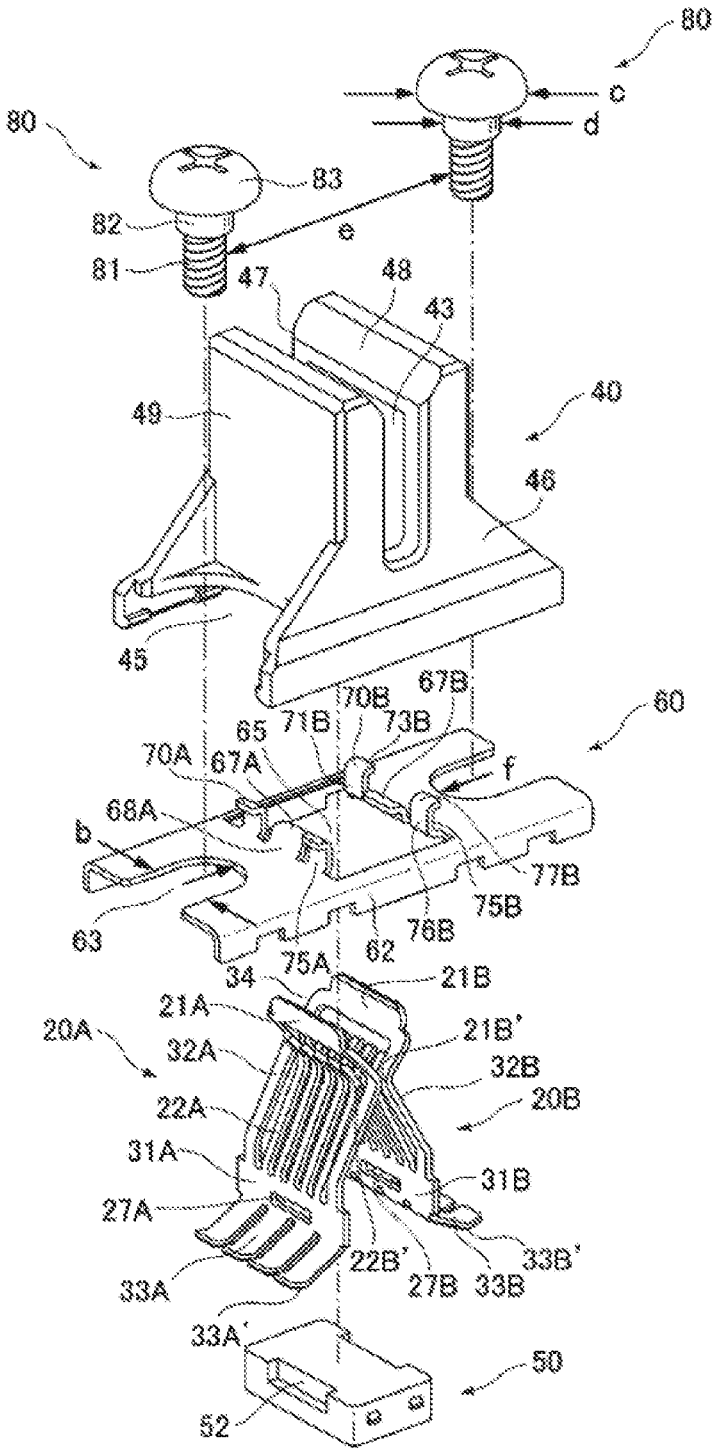
FIG. 2 is an exploded perspective view showing the electrical connection device according to the embodiment of the present invention.

FIG. 1 is a perspective view showing an electrical connection device 1 in use according to an embodiment of the present invention, and FIG. 2 is an exploded perspective view showing the electrical connection device 1 according to the embodiment of the present invention, respectively.

As shown in FIG. 1, the electrical connection device 1 is used in a state of being attached on a planar surface 4 of a wiring board 3, which is a main busbar. According to the electrical connection device 1, for example, a plate conductive member such as a busbar 5, which is a sub busbar, is moved down or up in a direction indicated with an arrow "a", so as to be attached to or removed from the electrical connection device 1. When the busbar 5 is inserted to the electrical connection device 1, the busbar 5 is held upright with the electrical connection device 1 on the planar surface 4 of the wiring board 3, so that the busbar 5 is electrically connected to the wiring board 3.

In the embodiment, the electrical connection device 1 generally has a laterally symmetrical shape as a whole. As well shown in FIG. 2, the electrical connection device 1 includes contact pieces 20, a base member 60, a pressing member 50, a cover 40, and shoulder screws 80. The base member 60 supports the contact pieces 20. The pressing member 50 prevents the contact pieces 20 from coming off from the base member 60 in cooperation with the base member 60. The cover 40 covers outsides of the contact pieces 20. The shoulder screws 80 are for mounting the electrical connection device 1 on the wiring board 3. Here, among those members, essential members for the electrical connection device 1 are the contact pieces 20 and the base member 60, and members other than those may be omitted.

Figure 3:
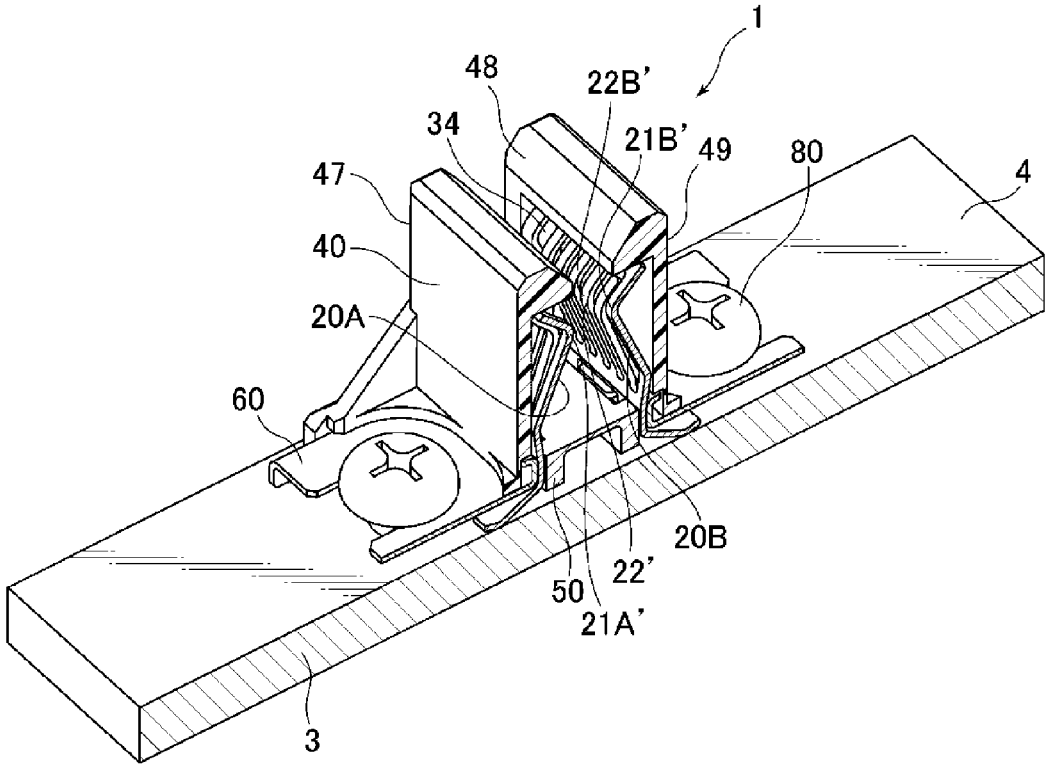
FIG. 3 is a perspective partial sectional view showing the electrical connection device shown in FIG. 1, taken along a lateral direction thereof, according to the embodiment of the present invention.
Figure 4:
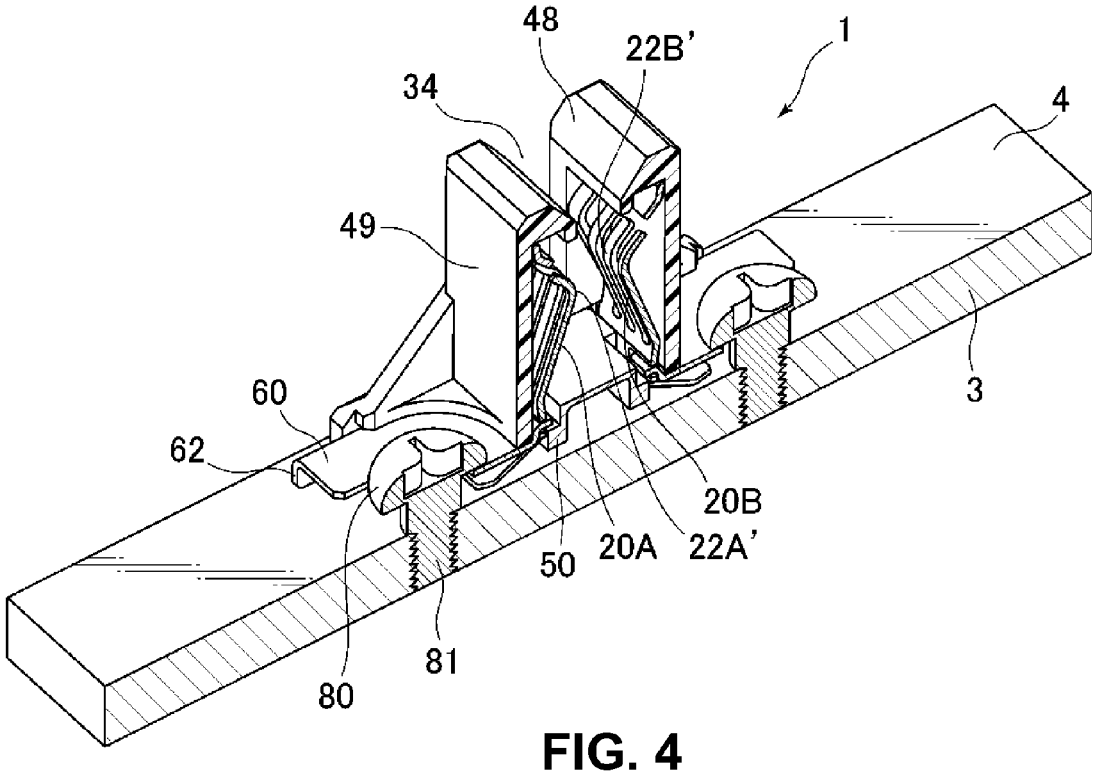
FIG. 4 is a perspective partial sectional view showing the electrical connection device shown in FIG. 1, taken along a lateral direction thereof, according to the embodiment of the present invention.
Figure 5:
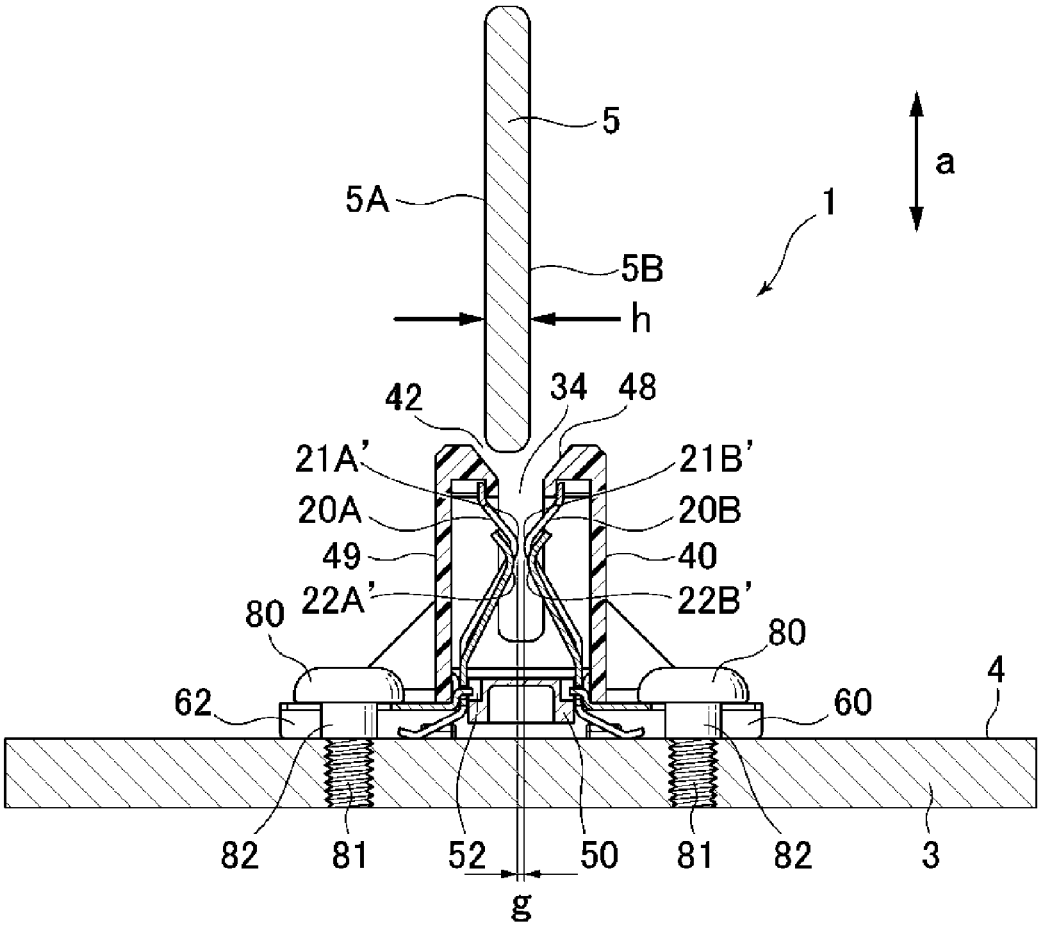
FIG. 5 is a partial sectional view showing the electrical connection device shown in FIG. 1, taken along the lateral direction thereof, according to the embodiment of the present invention, wherein the electrical connection device is in a state before connecting a busbar to contact pieces.
Figure 6:
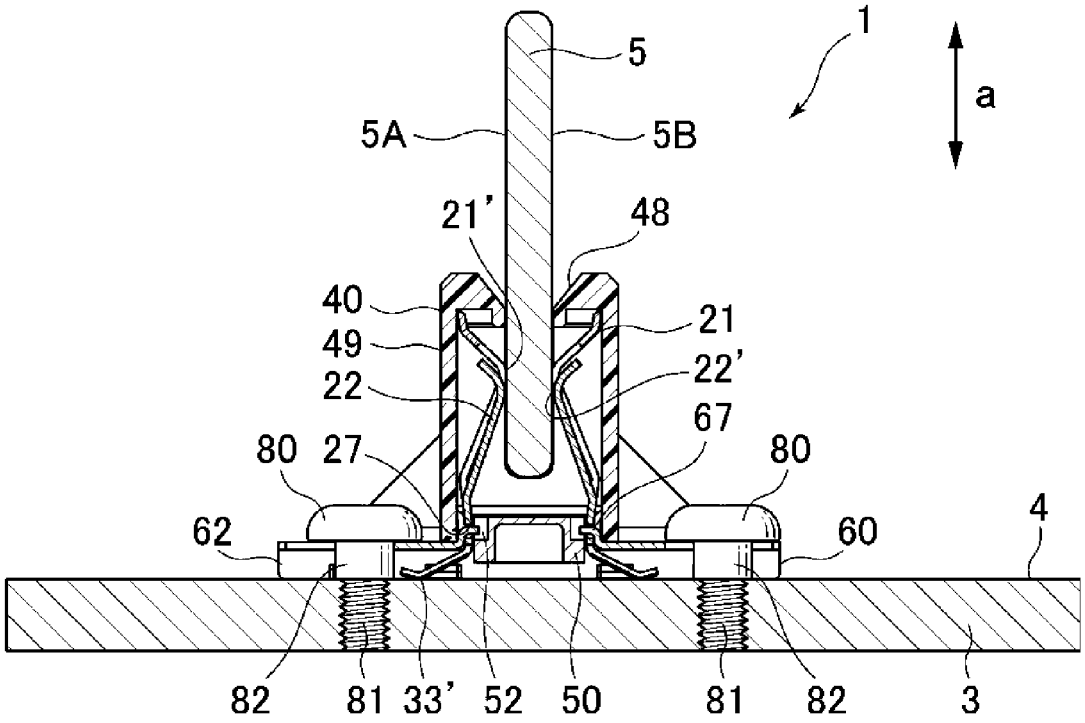
FIG. 6 is a partial sectional view showing the electrical connection device shown in FIG. 1, taken along the lateral direction thereof, according to the embodiment of the present invention, wherein the electrical connection device is in a state after connecting the busbar to the contact pieces.
Figure 7:
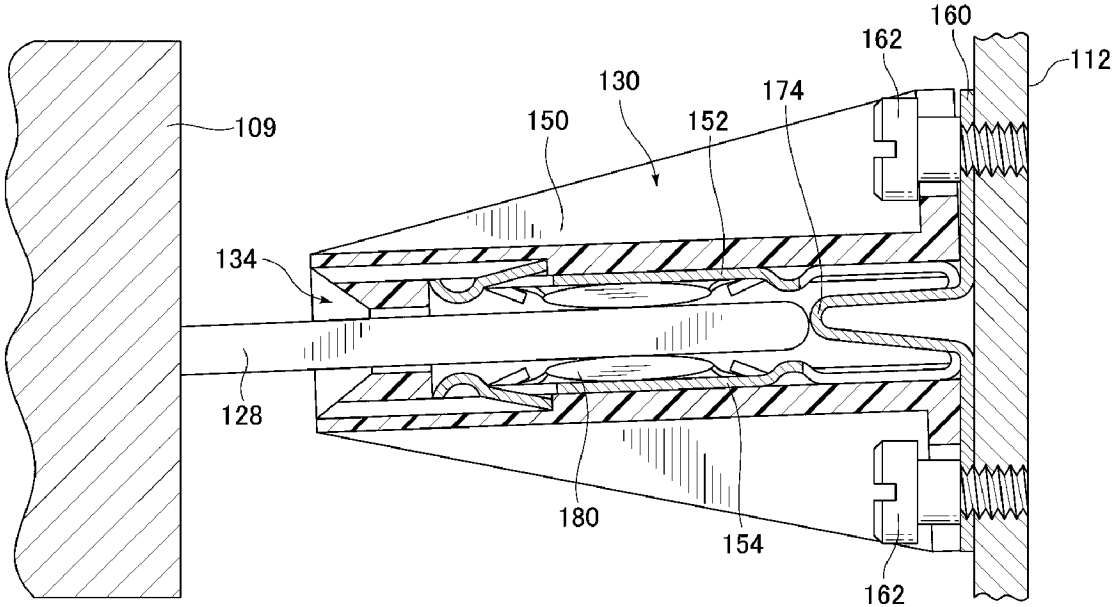
FIG. 7 Prior Art
FIG. 7 is a sectional view showing an example of a conventional electrical connection device.

Referring also to FIGS. 3 through 6, a configuration of the electrical connection device 1 will be fully described. FIGS. 3 and 4 are perspective partial sectional views showing the electrical connection device 1, taken along lateral directions of FIG. 1, but taken at different cross-sections from each other. FIGS. 5 and 6 are partial sectional views, taken along lateral directions of FIG. 1. More specifically, FIG. 5 shows a state before connecting the busbar 5 to contact pieces 20, and FIG. 6 shows a state the busbar 5 is held upright by the electrical connection device 1.

In the embodiment, the contact pieces 20 are one of the essential members of the electrical connection device 1. The contact pieces 20 are composed of a set of a contact piece 20A and a contact piece 20B, which have the same shape and are disposed to face each other. Upon holding the busbar 5 with the electrical connection device 1, the busbar 5 is inserted in an insertion opening formed by the contact pieces 20A and 20B. Hereunder, as necessary, reference numerals of members related to the contact piece 20A is affixed with "A" and those of members related to the contact piece 20B are affixed with "B", respectively. Here, when it is not necessary to distinguish between them, those letters may be omitted.

In the embodiment, the contact pieces 20 are formed from one thin sheet metal having a certain width by stamping and bending. Since the contact pieces are formed from sheet metal, the contact pieces 20 have good durability as well as good elastic action. In addition, since the contact pieces 20 can be easily made by stamping and bending, it is achievable to produce the contact pieces 20 inexpensively. The contact piece 20A includes an arm portion 32A extending along one planar surface 5A of the busbar 5, a leg portion 33A extending along a planar surface 4 of the wiring board 3, and a base portion 31A provided between the arm portion 32A and the leg portion 33A.

In the embodiment, the contact piece 20A has a generally L-shape as a whole, when viewed from a side thereof. Similarly, the contact piece 20B includes an arm portion 32B extending along the other planar surface 5B of the busbar 5, a leg portion 33B extending along the planar surface 4 of the wiring board 3, and a base portion 31B provided between the arm portion 32B and the leg portion 33B. The contact piece 20B has a generally L-shape as a whole, when viewed from a side thereof. The arm portions 32A and 32B are portions mainly used for contacting with the busbar 5. The leg portions 33A and 33B are portions mainly used for contacting with the wiring board 3. The base portions 31A and 31B are portions to be fulcrums for motion of the contact pieces 20.

Each arm portion 32 includes a frame-like contact section 21 and a plurality of strip-like contact sections 22. The frame-like contact section 21 is a portion that has a square-bottomed U-shape, from the base portion 31 toward a portion to contact with the busbar 5. The frame-like contact portion 21 is provided to improve action of the strip-like contact portions 22.

On the other hand, the strip-like contact sections 22 are portions provided to be like cantilevers from each base portion 31 toward the side for contacting with the busbar 5, while being surrounded by the respective frame-like contact portions 21. The strip-like contact portions 22 are provided mainly for obtaining electrical connection. The plurality of the strip-like contact sections 22 has the same strip-like shape and is arranged at the equal pitch from each other along a width direction of each contact piece 20.

Each frame-like contact portion 21 and the strip-like contact portions 22 thereof respectively have contact points 21' and 22', which are bent so as to protrude toward a side for contacting with the busbar 5. As well shown in FIGS. 5 and 6, the positions of the contact point 21' of the frame-like contact portion 21 and the positions 22' of the strip-like contact portions 22 are somewhat misaligned from each other in a direction of the arrow "a", an insertion/removal direction of the busbar 5.

When the busbar 5 is inserted in an insertion opening 34 between the contact piece 20A and the contact piece 20B, the busbar 5 first contacts with the contact points 21' of the frame-like contact portions 21. Then, the busbar 5 contacts with the contact points 22' of the strip-like contact portions 22. Accordingly, with the configuration, when the busbar 5 contacts with the contact points 21' of the frame-like contact portions 21 before contacting with the contact points 22' of the strip-like contact portions 22, it is achievable to blow off arc, which causes increase of electrical contact resistance, by the frame-like contact portions 21, and thereby prevent deterioration of the strip-like contact portions 22.

In order to make contact with the wiring board 3 easier, the leg portions 33 also have contact points 33' similarly to the arm portions 32. The contact points 33' of the leg portions 33 are formed by bending so as to protrude toward the side for contacting with the planar surface 4 of the wiring board 3. As well shown in FIG. 6, the contact points 33' can elastically contact with the planar surface 4 at least upon inserting the busbar 5 between the contact piece 20A and the contact piece 20B to hold the busbar 5 by the electrical connection device 1.

In the embodiment, the base portions 31 support the contact pieces 20, and serve as fulcrums in movements of the contact pieces 20. In order to securely support the contact pieces 20, there are engaging holes 27A and 27B near the center of the base portion 31 in the width direction thereof. Using those engaging holes 27A and 27B, it is achievable to prevent the contact pieces 20 from coming off from the base member 60. Here, those engaging holes 27A and 27B can be enlarged in width directions thereof corresponding to the wide contact pieces 20. With the engaging holes 27A and 27B having certain widths, it is achievable to prevent the contact pieces 20A and 20B from coming off in more stable state.

In the embodiment, the base member 60 is an essential member of the electrical connection device 1, similarly to the contact pieces 20. The base member 60 prevents the contact pieces 20 from coming off from the base member 60 in cooperation with the pressing member 50, and serves as a fulcrum upon movement of the contact pieces 20. The base member 60 is made of metal, and has generally a planar shape as a whole. Since it is made of metal, for example, it is achievable to increase the durability against the contact pieces 20, and electrically connect between the contact pieces 20 and the wiring board 3 via the base member 60. Furthermore, it is also achievable to further reinforce the contact between the contact pieces 20 and the wiring board 3.

On each lateral edge of the base member 60, there is provided a lifting portion 62, which is formed by bending the edge downward. With the lifting portions 62, it is achievable to keep the base member 60 away from the planar surface 4 of the wiring board 3 and form space between the base member 60 and the wiring board 3 so as to displace and accommodate the leg portions 33 of the contact pieces 20.

Since the base member 60 also has a laterally symmetrical shape similar to other members, in order to distinguish between left portions and right portions thereof, a letter "A" or "B" is affixed after the reference numerals as necessary. Here, when it is not necessary to identify if it is a left portion or a right portion, those letters are omitted.

In the center of the base member 60, there is provided a generally rectangular insertion hole, to which the contact pieces 20 can be inserted 20. Furthermore, on the respective left and right edges of the insertion through holes 65, there are three upright portions 68, 70, and 75 along the insertion direction. At an end part 67 of each upright portion 68 provided in the center, there is formed an engaging protrusion 67 by bending for about 90 degrees toward the side of the insertion through hole 65. The engaging protrusions 67 are provided corresponding to the engaging holes 27 provided on the base portions 31 of the contact pieces 20.

Since the engaging protrusions 67 are relatively loosely fitted in the engaging hole 27 upon assembling of the electrical connection device 1, the engaging protrusions 67 can support the contact pieces 20 while enabling the contact pieces to make some displacement. Here, since the contact pieces 20 are relatively loosely attached on the base portion 31, at the time of being in a state before holding the busbar 5 with the electrical connection device 1, it is possible to cause certain displacement in the contact pieces 20. Therefore, it is achievable to accept physical displacement of the busbar 5, a plate conductive member, relative to the electrical connection device 1 when the electrical connection device 1 receives the busbar 5.

In the embodiment, the upright portions 70 and 75 are respectively disposed at positions so as to interpose the upright portion 68 in between. On the side of the insertion through hole 65, the upright portions 70 and 75 respectively form abutting surfaces 71 and 76 that abut against planar surfaces of the base portions 31 of the contact pieces 20. By leverage action, the contact pieces 20 can move, using the contacting parts thereof, which contact with the abutting surfaces 71 and 76, as fulcrums. The end parts 73 and 77 of the upright portions 70 and 75 are bent for generally 90 degrees toward the side opposite the end parts 67 of the upright portions 68, i.e., on the side opposite the insertion through hole 65. By forming the bent portions, the end parts 73 and 77 of the upright portions 70 and 75 will not interfere with the movements of the contact pieces 20.

In the embodiment, the pressing member 50 is provided between the base portion 31A of the contact piece 20A and the base portion 31B of the contact piece 20B. The pressing member 50 has engaging recesses 52 so as to fit to the engaging protrusions 67 of the base member 60. While the engaging protrusions 67 of the base member 60 penetrates the engaging holes 27 of the contact pieces 20, the engaging protrusions 67 are fitted in the engaging recesses 52 of the pressing member 50. As a result, it is achievable to avoid interference with the pressing member 50 and the engaging protrusion 67 and to prevent the contact piece 20A and the contact piece 20B from coming off from the insertion through hole 65 with a simple configuration.

Here, being different from the contact pieces 20 and the base member 60, the pressing member 50 is not an essential member of the electrical connection device 1. For example, as is obvious from FIG. 6, when the busbar 5 is in a state of being inserted in the insertion opening 34 formed between the contact piece 20A and the contact piece 20B, the engaging protrusions 67 of the base member 60 will not come out from the engaging holes 27 provided on the base portions 31 of the contact pieces 20. As a result, the contact piece 20A and the contact piece 20B will not come off from the base member 60.

However, when the busbar 5 is in a state before being inserted in the insertion opening 34 between the contact piece 20A and the contact piece 20B, e.g., in a state of FIG. 5, without a certain means, the contact piece 20A and/or the contact piece 20B could easily come off from the base member 60 through the insertion holes 65. Therefore, it is preferable to provide the pressing member 50, but it is not essential to provide the pressing member 50. Here, alternately, it is also possible to enhance the effect of preventing the coming off by bending the end parts of the engaging protrusions 67 in an upright direction to make a cranked shape.

On the both left and right end portions of the base member 60, there are provided notches 63, each of which is composed of semicircular part and a rectangular part. Upon attaching the base member 60 to the wiring board 3, without completely fixing onto the wiring board 3, the electrical connection device 1 can be attached on the wiring board with the shoulder screws 80 disposed via the notches 63 so as to be able to float in surface directions on the planar surface 4 of the wiring board 3.

More specifically, the diameter "b" of the notches 63 provided on the base member 60 is smaller than the diameter "c" of the screw heads 83 of the shoulder screws 80, and is larger than the diameter "d" of the enlarged diameter shanks 32, each of which is provided between the screw head 83 and screw threads 81 of the shoulder screw 80. Moreover, the distance "e" between the shoulder screws 80 after being fixed on the wiring board 3 is set larger than a distance "f" between vertexes of the notches 63A and 63B. Therefore, even after the shoulder screws 80 are fixed on the wiring board 3, the electrical connection device 1 can float in surface directions of the planar surface 4.

By adding such floating action, it is achievable to easily allow the busbar 5 to displace relative to the electrical connection device 1 upon receiving the busbar 5 in the electrical connection device 1. Here, needless to say, by suitably adjusting the dimensional relations, it is also possible to float the electrical connection device 1 only in one of the surface directions, instead of any directions of the surface.

In the embodiment, the cover 40 is an optional member to include, similarly to the pressing member 50. The cover 40 is made of resin, and covers generally around the contact pieces 20A and 20B and covers generally the whole upper part of the electrical connection device 1. With the cover 40, it is achievable to protect the contact pieces 20, as well as to protect users from electric shock. Here, even after attaching the cover 40, it is still possible to access the contact pieces 20A and 20B, and the cover 40 will not interfere with movements of the contact pieces 20A and 20B.

The cover 40 mainly includes a pair of upright planar side walls 49, a front wall 46, a rear wall 47, and a bottom planar part. The pair of the planar side walls 49 covers side surfaces of the arm portions 32A and 32B of the contact pieces 20A and 20B. The front wall 46 and the rear wall 47 are disposed to joint side edges of the side walls 49, and have somewhat trapezoidal shapes at the bottom ends, i.e., open fan shapes. The bottom plate part joins between the side walls 49 and the front wall 49 or the rear wall 47. On the bottom plate part, there are formed generally semicircular notches 45 so as to be able to place the shoulder screws 80.

At the center of the tops of the front wall 46 and the rear wall 47, there is provided a U-shaped access opening 43 to insert/remove the busbar 5. The amount of insertion of the busbar 5 can be limited by adjusting the vertical depth of the access opening 43. Through the access opening 43, the busbar 5 can contact with the contact pieces 20A and 20B. Here, around an insertion opening 42 of the access opening 43, it is also possible to provide a inclined guide surface 48 to make guiding of the busbar 5 easier.

Lastly, an operation of the electrical connection device 1 according to the embodiment of the present invention will be described.

Upon transitioning from the state of FIG. 5 to the state of FIG. 6, i.e., from the state before holding the busbar 5 with the electrical connection device 1 to the state of holding the busbar upright with the electrical connection device 1, it is possible to accommodate misalignment of the busbar 5 relative to the electrical connection device 1, using the floating action of the electrical connection device 1 and the backlash of the contact pieces 20.

Moreover, according to the embodiment of the present invention, using the notches 63 of the base member 60 and the shoulder screws 80, the electrical connection device 1 is provided on the planar surface 4 of the wiring board 3 so as to be able to float in the surface directions, and the contact pieces 20 can move by leverage, using the base portions 31 as fulcrums. As a result, it is possible to accommodate the misalignment of the busbar 5 relative to the electrical connection device 1, upon inserting the busbar 5 from the insertion opening 34 formed between the arm portion 32A of the contact piece 20A and the arm portion 32B of the contact piece 20B.

Upon insertion, the busbar 5 first abuts the inclined surfaces 48 of the cover 40, and relatively large misalignment between the busbar 5 and the electrical connection device 1 is corrected by the floating action of the electrical connection device 1. Then, the busbar 5 abuts the contact pieces 20, and relatively small misalignment between the busbar 5 and the insertion opening 34 is corrected using the backlash of the contact pieces 20.

In the embodiment, the insertion opening 34 is formed between the contact points 21A' and the contact points 21B' and between the contact points 22A' and the contact points 22B'. The contact points 21A' are provided at the frame-like contact portion 21A of the arm portion 32A of the contact piece 20A. The contact points 21B' are provided on the frame-like contact portion 21A of the arm portion 32B of the contact piece 20B. The contact points 22A' are provided on the strip-like contact portions 21A of the arm portion 32A of the contact piece 20A. The contact points 22B' are provided on the strip-like contact portions 22B of the arm portion 32B of the contact piece 20B.

In the embodiment, the size "g" of the insertion opening 34 formed between those contact points are set smaller than a thickness "h" of the busbar 5. Therefore, upon inserting the busbar 5 in the insertion opening 34, the arm portion 32A of the contact piece 20A, especially the contact points 21A' and 22A' will certainly contact with the one planar surface 5A of the busbar 5.

Through this contact, the arm portion 32A is urged to the side of the planar surface 4 of the wiring board 3. In response to this, the leg portion 33A of the contact piece 20A is urged to the side of the wiring board 3 having the base portion 31A as fulcrum. In short, upon holding the busbar 5, the contact points 21A' and 22A of the arm portion 32A serve as power points, the base portion 31A serves as a fulcrum, and the contact point 33' of the leg portion 33 serves as a point of action. By leverage, the contact force occurred between the busbar 5 and the contact piece 20A is transmitted to the contact point 33A' of the leg portion 33A. As a result, the leg portion 33A of the contact piece 20A is urged to the side of the wiring board 3 and pressed onto the planar surface 4.

Similarly, when the busbar 5 is inserted in the insertion opening 34, the arm portion 32B of the contact piece 20B, especially the contact points 21B' and 22B' thereof certainly contact with the one planar surface 5B of the busbar 5. Through this contact, the arm portion 32B is urged to the side of the planar surface 4 of the wiring board 3. In response to this, the leg portion of the contact piece 20B is urged to the side of the wiring board 3, having the base portion 31B as fulcrum.

As a result, by leverage, the contact force occurred between the busbar 5 and the contact piece 20B is transmitted to the contact point 33B' of the leg portion 33B, and the leg portion 33B of the contact piece 20B is urged to the side of the wiring board 3 and pressed to the planar surface 4. As a result, it is achievable to reinforce the contact between the leg portions 33A and 33B and the wiring board 3, and secure electrical connection of the contact pieces 20A and 20B to the wiring board 3 and to the busbar 5.

In addition, upon holding the busbar 5 with the electrical connection device 1, the leg portions 33A and 33B of the contact pieces 20A and 20B, which have spring property, contact with the busbar 5 with certain force, and the leg portions 33A and 33B of the contact pieces 20A and 20B also contact with the wiring board 3 with certain force. Therefore, the busbar 5 is stably held with the electrical connection device 1. Furthermore, according to the above-described configuration, upon holding the busbar 5 upright with the electrical connection device 1, it is possible to have the contact pieces 20 contact with the both planar surfaces 5A and 5B at the same time. Therefore, it is achievable to keep the force evenly exerted on the busbar 5 and the electrical connection device 1.

Here, according to the embodiment, an example is described, in which the contact pieces 20 are a pair of contact pieces 20A and 20B, but the contact pieces 20 do not have to be a pair, nor plural. For example, it is also possible to provide only one contact piece by extending the abutting surface of the base portion in the upright direction so as to have it as a wall that faces the arm portion. As is obvious, also in this case, it is achievable to obtain effects of the present invention.

In addition, according to the above-described embodiment, the base member 60 has the engaging protrusions 67 and the pressing member 50 has the engaging recesses 52. However, instead, the base member 60 can have the engaging recesses (not illustrated) and the pressing member 50 can have the engaging protrusions (not illustrated). Here, in this case, the pressing member 50 is an essential member.

The present invention is applicable in various electrical connection devices, in which a wiring board and a plate conductive member are electrically connected while holding the plate conductive member upright on a planar surface of the wiring board.

The disclosure of Japanese Patent Applications No. 2014-102533, filed on May 16, 2014, is incorporated in the application by reference.

While the present invention has been explained with reference to the specific embodiments of the present invention, the explanation is illustrative and the present invention is limited only by the appended claims.

What is claimed is:

1. An electrical connection device to be attached to a wiring board for holding a plate conductive member so that the wiring board is electrically connected to the plate conductive member, comprising:

a contact piece including an arm portion, a leg portion, and a base portion disposed between the arm portion and the leg portion; and a base member to be attached to the wiring board for supporting the contact piece at the base portion thereof, wherein said base member is to be attached to the wiring board so that the base member is movable in parallel to the wiring board, and said contact piece is arranged so that the plate conductive member pushes the arm portion to urge the leg portion against the wiring board with the base portion as a pivot when the plate conductive member contacts with the arm portion.

2. The electrical connection device according to claim 1, wherein said arm portion is formed to extend along the plate conductive member when the electrical connection device holds the plate conductive member, said leg portion is formed to extend along the wiring board when the electrical connection device is attached to the wiring board, and said arm portion includes a contact point protruding toward the plate conductive member when the electrical connection device holds the plate conductive member.

3. The electrical connection device according to claim 1, wherein said contact piece includes a first contact piece and a second contact piece arranged to face each other, said first contact piece includes a first arm portion, a first leg portion, and a first base portion disposed between the first arm portion and the first leg portion, said first contact piece further includes a first contact point formed on the first arm portion, said second contact piece includes a second arm portion, a second leg portion, and a second base portion disposed between the second arm portion and the second leg portion, said second contact piece further includes a second contact point formed on the second arm portion so that an insertion opening is formed between the first contact point and the second contact point for inserting the plate conductive member, said insertion opening has a size smaller than a thickness of the plate conductive member, said first contact piece is arranged so that the plate conductive member pushes the first arm portion to urge the first leg portion against the wiring board with the first base portion as a pivot when the plate conductive member contacts with the first arm portion, and said second contact piece is arranged so that the plate conductive member pushes the second arm portion to urge the second leg portion against the wiring board with the second base portion as a pivot when the plate conductive member contacts with the second arm portion.

4. The electrical connection device according to claim 3, further comprising a pressing member disposed between the first base portion and the second base portion.

5. The electrical connection device according to claim 4, wherein said first contact piece further includes a first engaging hole, said second contact piece further includes a second engaging hole, said pressing member includes a first engaging portion, and said base member includes a second engaging portion passing through the first engaging hole to engage with the first engaging portion.

6. The electrical connection device according to claim 5, wherein said first engaging hole is formed to extend in a width direction of the first contact piece, and said second engaging hole is formed to extend in a width direction of the second contact piece.

7. The electrical connection device according to claim 3, further comprising a cover member for covering at least a part of the first contact piece and a part of the second contact piece.

8. The electrical connection device according to claim 1, wherein said base member is formed of a metal material.

* * * * *